United States Patent [19]

Hebert

[11] Patent Number: 4,509,499

[45] Date of Patent: Apr. 9, 1985

[54] ENERGY EFFICIENT DAMPER FOR A FURNACE

[76] Inventor: Alfred M. Hebert, Skidmore Rd., Pleasant Valley, N.Y. 12569

[21] Appl. No.: 600,909

[22] Filed: Apr. 16, 1984

Related U.S. Application Data

[63] Continuation-in-part of Ser. No. 342,817, Jan. 26, 1982, Pat. No. 4,449,512.

[51] Int. Cl.[3] ..... F23L 3/00

[52] U.S. Cl. ..... 126/292; 126/285 R; 126/312; 236/45; 236/93 R

[58] Field of Search ..... 126/285 R, 288–293, 126/295, 312, 307 R, 307 A; 236/45, 1 G, 93 R; 251/11

[56] References Cited

U.S. PATENT DOCUMENTS

| | | | |
|---|---|---|---|
| 1,743,731 | 1/1930 | Scott | 126/285 R |
| 1,830,575 | 11/1931 | Tjernblom | 236/45 |
| 2,232,981 | 2/1941 | Swanson | 236/45 |
| 2,557,210 | 6/1951 | Viola et al. | 236/45 |
| 4,146,048 | 3/1979 | McCabe | 126/285 R |
| 4,449,512 | 5/1984 | Hebert | 126/292 |

FOREIGN PATENT DOCUMENTS

| | | | |
|---|---|---|---|
| 74643 | 1/1945 | Belgium | 126/285 R |

*Primary Examiner*—James C. Yeung
*Attorney, Agent, or Firm*—Martin J. Spellman, Jr.

[57] ABSTRACT

A damper for sealing and unsealing a vertical furnace exhaust flue pipe to minimize the escape of heat when the furnace is not operating is disclosed. The damper comprises a cylindrical body adapted to form a section of vertical flue pipe having inner and outer walls. The cylindrical body has a top opening and a bottom opening and at least one transverse hinge rod horizontally transversing the body carried by opposed apertures in opposing wall portions of the body, an annular rim mounted on the inner wall of the body and a pair of oppositely extending gull-wing shaped damper shutters pivotably mounted on said hinge rod. Each of the gull-wing shaped damper shutters have upper and lower surfaces, a lower section and an outer upper section, and in the closed condition the lower sections of the shutters extend upwardly and outwardly at approximately a 45° angle with the outer upper sections of the shutters extending horizontally and slightly spaced from the inner walls of the damper section. The upper surface of said annular rim is contoured to match the lower surface of said shutters along their edges in the closed condition so that the edges of the lower surface of said shutters rest on the rim to close said damper. The lower edges of said shutters engage the annular rim to prevent the lower edges from becoming wedged against the inner wall of the damper section, the gull-wing shaped damper shutters opening to a vertical position when said furnace is operating and closing when said furnace is not operating.

3 Claims, 8 Drawing Figures

ENERGY EFFICIENT DAMPER FOR A FURNACE

CROSS-REFERENCE TO RELATED APPLICATION

This application is a continuation-in-part application of my co-pending application Ser. No. 342,817 filed Jan. 26, 1982, now U.S. Pat. No. 4,449,512.

BACKGROUND OF THE INVENTION

1. Field of the Invention

This invention relates to furnaces used to heat structures and is particularly applicable to furnaces used to heat residential structures.

With the increase in the cost of fuel, particularly petroleum-based fuel, as well as the uncertainty of its uninterrupted availability from foreign sources, there is increasing concern for obtaining the maximum possible efficiency from residential heating systems. In the past, approximately 25% of the heat produced when the furnace was running escaped up the chimney rather than being transferred to the house. In addition, when the furnace is turned off, drafts through the furnace continue to pull warm air up the chimney and out of the house, usually from the basement where most furnaces are located in family residences. This loss due to chimney draft while the furnace is off accounts for an additional 25% loss of the heat produced.

A number of electrically operated flue dampers which depend upon electrical switching and safety relays to assure operation when the furnace is turned on and to power it closed have been put on the market in recent years. Obviously, such devices present safety hazards, and their cost is very significant to the average homeowner.

The present invention is directed to an efficient flue damper for preventing heat loss up the chimney when the furnace is in the off condition and also serves to minimize the heat loss during operation of the furnace.

2. Prior Art

U.S. Pat. No. 1,743,731 Scott discloses a flue damper consisting of a pair of plate wing members positioned within the smoke pipe which are pushed open when the furnace is on but fall into a closed position through gravity when the furnace is off. They are positioned along an oblique horizontal axis in the horizontal flue.

U.S. Pat. No. 1,830,575 Tjernblom discloses a damper for supplying the air to the fire pot from a blower. In this case, the damper closes to prevent a natural draft of the fire by preventing the chimney from drawing in an oversupply of air to the fire pot. The damper is comprised of two horizontally pivoted flappers, the upper of which overlaps the pivot of the lower.

Another approach is illustrated in U.S. Pat. No. 2,557,210 Viola, et al wherein a horizontally pivoted flapper valve with a weight control is utilized. In this case, an adjustment is utilized so that the damper will just close when there is no fire in the furnace and the damper will open with a very light draft.

SUMMARY OF THE INVENTION

According to the present invention, there is provided a flue damper which operates in its preferred form solely by the force of gravity and the air flow through the furnace. The force of air and exhaust products flow readily opens the damper upon the initial operation of the furnace. The damper shuts immediately when the furnace is turned off thereby preventing the flow-through of air through the furnace and up the chimney draft. The latter flow ordinarily would cause a great loss of residual heat from the furnace and the surrounding space in which it is located.

The flow-through also creates uncomfortable drafts, particularly within the area of the furnace in the structure which is usually the basement, once the furnace is turned off.

According to the present invention, in the case of an oil-fired furnace where there is an additional forcing of air through the furnace by the burner turbine, the damper will open simply by the force of the air flow alone and is closed by gravity alone.

In the case of a gas-fired furnace where the velocity of air through the furnace is less than in the oil-fired furnace, a thermostatic spring is employed to facilitate the opening in the event that the air flow would be insufficient. This is accomplished by diverting a small portion of the exhaust stream over an externally mounted thermostatic spring coil on the side of the damper and connected to the damper shutter(s).

The damper, according to the present invention, which mounted in the vertical portion of the furnace flue, comprises a cylindrical sheet metal structure which is mounted in line with the flue and is usually on the order of 6–8" in diameter for most residential installations. A pair of "gull-wing" shutters are pivotally mounted on one or a pair of hinge rods running parallel to each other and transversely to the longitudinal axis of the damper. The lower portion of the shutters extend upwardly and outwardly at approximately a 45° angle, and the outer portions of the shutters in the closed condition extend horizontally to just short of the inner walls of the damper structure to make edge contact on the upper lip of an internal annular rim which runs around the internal circumference of the damper section. The upper surface or lip of the rim conforms to the shape of the gulf wing shutters in the closed condition of the damper. The lower surface edge area of the gulf wing shutters and the lip of the rim which conforms to the shape of the shutters very effectively close the damper. The wing shutters are dimensioned to be spaced slightly from the inner walls of the damper to avoid wedging closed and lay on the lip of the collar when closed.

This construction allows the damper to open with a very slight air pressure from the furnace because of the counter-balancing effect of the gull-shaped shutter which also assists in affirmatively closing the damper when the flow of furnace air ceases. The edge contact of the shutters on the rim and spaced slightly from the internal walls serves to prevent the outer edge of the wings from otherwise wedging against the internal surface of the damper walls. This damper, which is simple in construction, prevents both the after-flow of warm air up the chimney or, conversely, the cool air down and greatly increases the heat efficiency of structures as demonstrated in the test runs described below.

In the case of the gas-fired furnace wherein the flow of air through the furnace is of a lesser velocity, the same gull-wing structure is utilized, but orifices above and below the hinge rods are provided to direct warm air from below the damper shutters over a thermostatic coil spring and then back into the damper above the shutters. The air passes through an enclosed box-like structure mounted externally on the wall of the damper section and encloses an end of at least one of the damper shutter hinge rods.

The thermostatic coil spring is secured at its outer end to the damper section outer wall and at its inner end to an end of the hinge rod for one of damper shutters in a known manner to cause opening of the shutter upon a temperature rise and closing upon a temperature drop. In most applications it is adjusted to affirmatively assure that when the temperature of the spring rises to approximately 100° F., the spring will cause the hinge rods to turn and move the gull-wing to the open position, and conversely, to affirmatively close the shutter as the temperature falls below 100° F. The second gull-wing shutter may also be opened by the thermostatic coil spring or, alternatively, may simply rely upon the flow of the air to open and gravity to close.

BRIEF DESCRIPTION OF THE DRAWINGS

In the accompanying drawings.

DETAILED DESCRIPTION OF THE ILLUSTRATIVE EMBODIMENT

Referring to the accompanying drawings, there is illustrated a specific embodiment of the invention. It should be understood that this embodiment is illustrative only and that the invention is defined and limited only by the accompanying claims.

Figure 1:
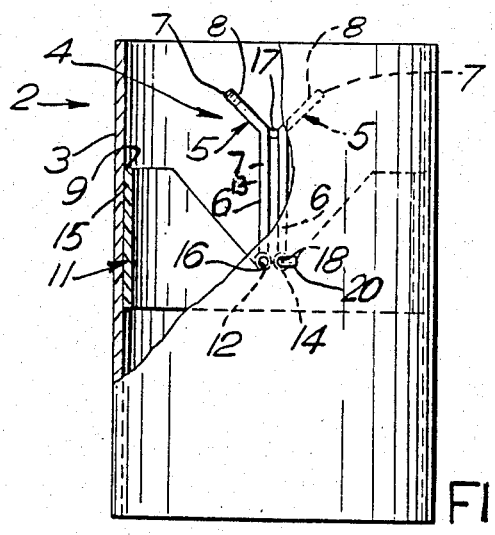
FIG. 1 is a side partially sectional view of a flue vertical section with a damper of the patent invention installed therein with the damper in the open position.
Figure 2:
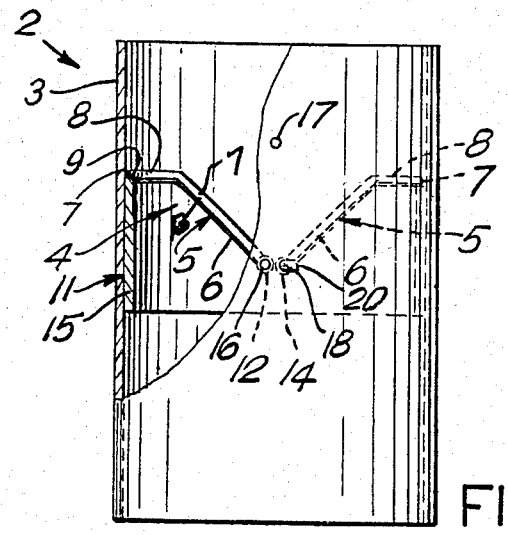
FIG. 2 is a side partial sectional view of a flue vertical section and the damper of the present invention installed therein with the damper in the closed position.
Figure 4:
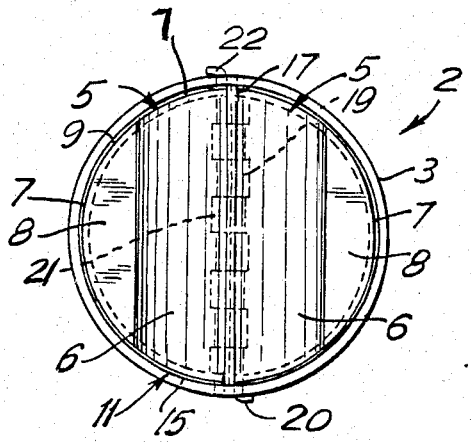
FIG. 4 is a top view partially in section of the damper in the position of FIG. 2.

The damper 2 of the present invention is shown in FIG. 1 in a side view and is comprised of cylindrical walls 3 of the usual sheet metal construction in furnace flue conduits. A pair 4 of damper shutters are comprised of a pair of gull-wing shaped shutters 5 having lower sections 6 and outer-upper sections 8. When the damper 2 is in a closed condition, as shown in FIGS. 2 and 4, the lower surfaces 13 of the shutters 5 rest along their edges 7 upon the upper edge 9 of the rim 15 of the annular rim 11 in edge contact therewith. This prevents the edges 7 of the shutters 5 from becoming wedged against the internal surfaces of the damper walls 3. The lower sections 6 of the wings 5 are mounted on hinge rods 12 and 14 which transverse the diameter of the damper section 2 and are retained within apertures 16 and 18 on opposite sides of the damper section 2. A stop rod 17 transverses the damper 2 to prevent the shutters 5 from swinging past vertical upon opening.

The ends of the rods 12 and 14 are provided with L-shaped bends 20 and 22 at the end to retain them in place.

The gull-shaped shutters 5 are hinged to the rods 12 and 14 by alternating sheet metal extensions 19 and 21 which are bent around the rods to serve as hinges.

Figure 3:
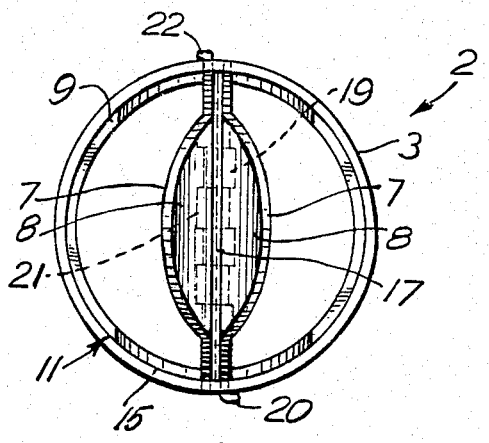
FIG. 3 is a top view partially in section of the damper in the position of FIG. 1.

As shown in FIGS. 3 and 4, the gull-wing shutters 5 are dimensioned to have a slight spacing from the internal walls 3 of the damper section 2 to avoid wedging, particularly in the closed position shown in FIGS. 2 and 4.

When the furnace is off and there is no flow of air upwardly through the damper section 2, the gull-wing shutters 5 are in the closed position of FIGS. 2 and 4. When the furnace is on and there is an upward flow of air, the gull-wing shutters 5 are pivoted to the upright position shown in FIGS. 1 and 3. Immediatley when the furnace is turned off, because of the position of the outer sections 8 of the wings, the wing shutters 5 "flop down" to a closed position.

Figure 5:
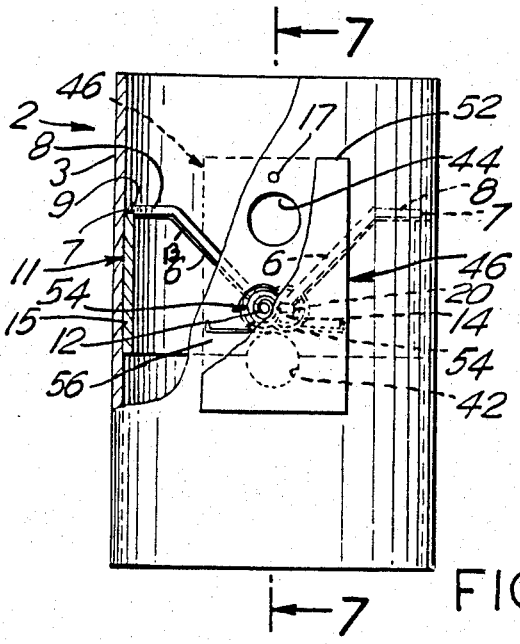
FIG. 5 is a side sectional view of an alternate flue damper according to this invention particularly adapted for use with gas furnaces showing a thermostatic spring to assist in opening one of the damper shutter wings.
Figure 6:
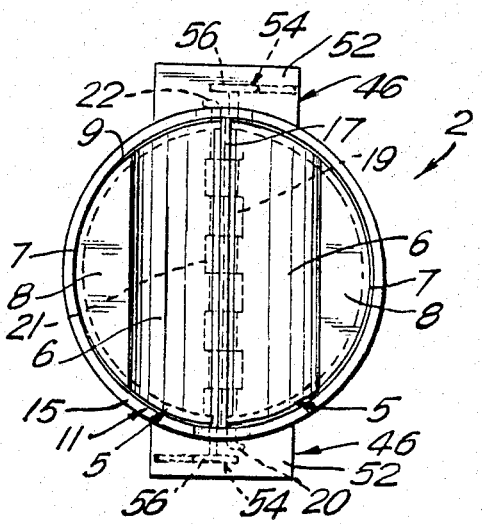
FIG. 6 is a top view of the damper of FIG. 5 in the closed position.
Figure 7:
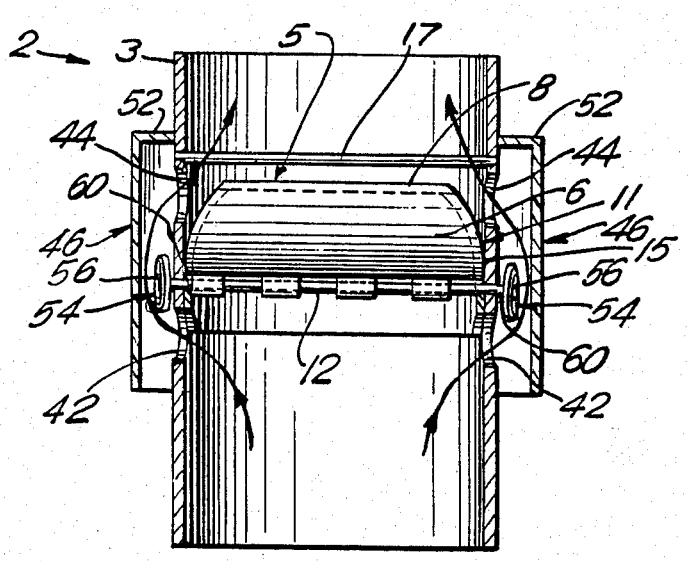
FIG. 7 is a section view of the damper of FIGS. 5 and 6 taken along lines 7—7 of FIG. 6.

In the case of a gas-fired furnace, it is desirable to use the alternative embodiment of FIGS. 5, 6, and 7 to affirmatively assure that at least one of the wings opens through the action of a thermostatic coil spring. As shown in FIGS. 5–7, the wing shutter structures 5 are the same as in the first embodiment, however, annular apertures 42 and 44 in the walls 3 approximately one inch in diameter are provided above and below the hinge rods 12 and 14 and are enclosed by a three-sided, box-like structure 46 closed at the top 52 as shown. A thermostatic coil spring 54 is mounted externally of the damper 2 at its outer end 56 to the wall 3 and at its inner end 60 to a hinge rod 12 or 14 of at least one of the gull-wing shutters 5. When the furnace is turned on, a portion of the warm air flowing up the damper flue exits the damper walls 3 through the aperture 42 and reenters through aperture 44. As the spring 54 is warmed, it will turn the gull-wing 5 into the open position. When the furnace is turned off, the flow of ambient air from the room runs through the box 46 and up through aperture 44 into the flue and cools the spring 54 down, causing the wing 5 to move to the closed position. The second gull-wing shutter may be similarly operated, however, in most cases it is sufficient that it is gravity-operated as in the oil furnace embodiment. It is generlly desirable that the thermostatic coil spring 54 cause the shutter 5 to open and close within the temperature range of 100°–120° F.

Figure 8:
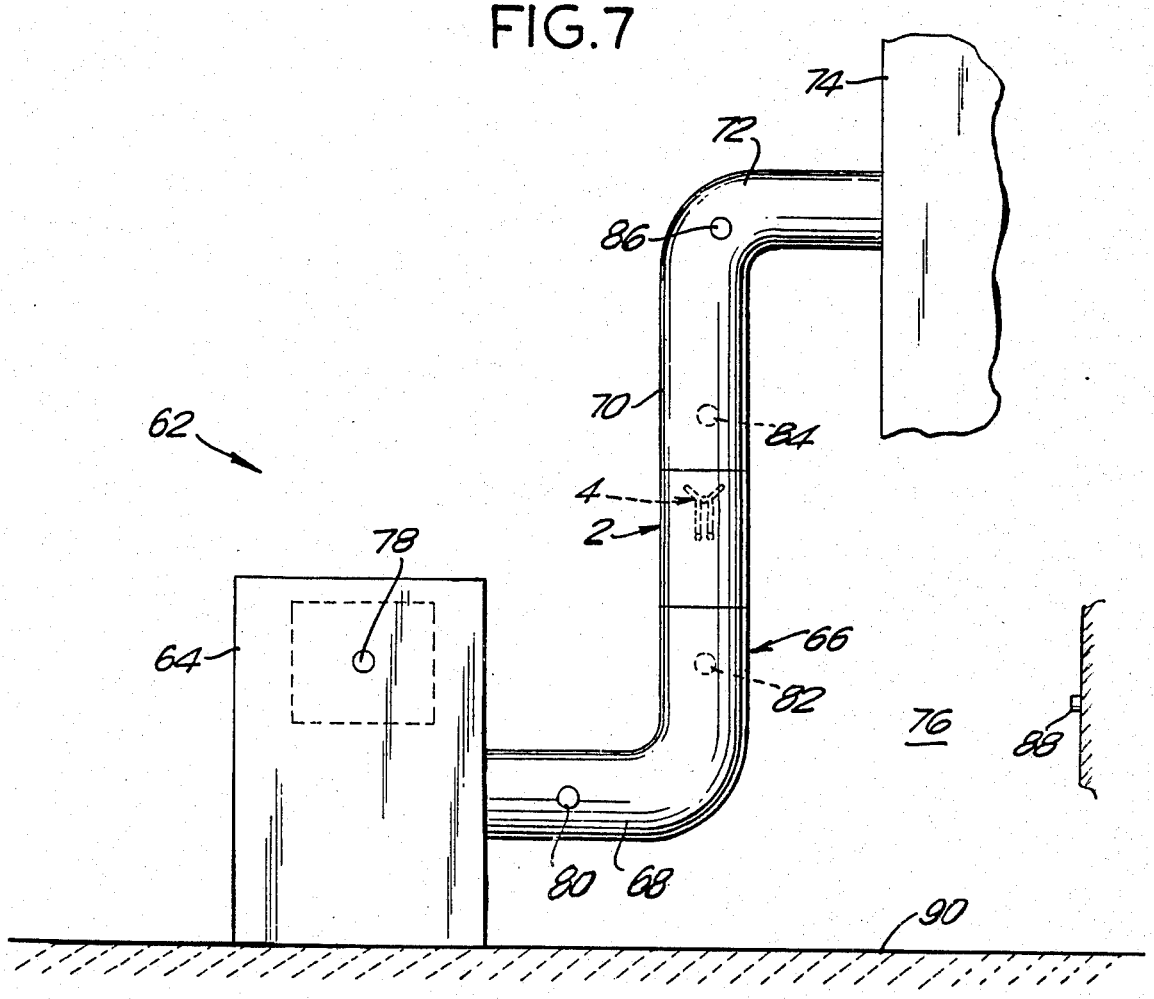
FIG. 8 is a schematic of a furnace and exhaust flue therefor with temperature sensors located at position to record the temperatures which are shown in Table I and II.

The operation of the damper 2 according to the present invention is reflected in the accompanying tables in which Table I refers to recorded temperatures to sensors at the locations shown in FIG. 8 without the damper in use during and after operation of the oil-furnace and hot water boiler at the indicated time intervals and wherein Table II shows the same information with the damper being utilized.

Referring to FIG. 8, an oil-fired furnace is indicated generally by 62 with a hot water boiler 64. The furnace is provided with an exhaust flue 66, having a lower section 68, a vertical section 70 in which the damper section 2 of the invention is located, and an upper section 72 connected to the building chimney 74. The furnace 62 is located in the basement of the residence indicated in general by 76.

Temperature sensors are located at the following locations: In the boiler 64 at 78 to record water temperature; on the outside of the lower portion 68 of the exhaust flue 66 at 80; internally in the vertical flue section 70 at 82 just below the damper section 2 of the invention; at 84 internally in the flue section 72 just above the damper section 2 of the present invention; and at 86 on the outside of the upper flue section 72. A temperature sensor 88 is also located within the basement within ten feet of the furnace, approximately four feet above the basement floor 90. Not shown is an outside thermometer to record the outside air temperature at the beginning and end of the test run. All temperatures are recorded in degrees of Fahrenheit.

TABLE I

| READING | | TIME | BOILER TEMP. | OUTSIDE FLUE STACK TEMPERATURE LOWER | OUTSIDE FLUE STACK TEMPERATURE UPPER | INSIDE FLUE STACK TEMPERATURE LOWER | INSIDE FLUE STACK TEMPERATURE UPPER | TIME FROM FURNACE SHUTDOWN | BASEMENT TEMPERATURE |
|---|---|---|---|---|---|---|---|---|---|
| | | | | | | | | OUTSIDE TEMPERATURE 30° | |
| START | 1 | | | | | | | | |
| | 2 | 11:52:30 | 150° | | | | | | 58° |
| | 3 | 11:54:30 | 155° | 90° | 100° | 540° | 470° | | |
| | 4 | 11:56:30 | 158° | 150° | 160° | 590° | 520° | | |
| | 5 | 11:58:30 | 165° | 185° | 600° | 530° | | | |
| | 6 | 12:00:30 | 175° | 210° | 205° | 605° | 535° | | |
| OFF | 7 | 12:01:30 | 180° | 210° | 205° | 605° | 535° | | |
| | 8 | 12:06:30 | 187° | 140° | 115° | 220° | 150° | 5 | |
| | 9 | 12:11:30 | 188° | 100° | 85° | 205° | 130° | 10 | |
| | 10 | 12:16:30 | 188° | 80° | 80° | 199° | 130° | 15 | |
| | 11 | 12:21:30 | 188° | 70° | 70° | 198° | 128° | 20 | |
| | 12 | 12:26:30 | 188° | 70° | 70° | 190° | 123° | 25 | |
| | 13 | 12:31:30 | 187° | 70° | 70° | 180° | 120° | 30 | |
| | 14 | 12:36:30 | 187° | 65° | 65° | 180° | 118° | 35 | |
| | 15 | 12:41:30 | 186° | 65° | 65° | 180° | 117° | 40 | |
| | 16 | 12:46:30 | 185° | 65° | 65° | 175° | 115° | 45 | |
| | 17 | 12:51:30 | 184° | 65° | 65° | 175° | 115° | 50 | |
| | 18 | 12:56:30 | 183° | 65° | 65° | 170° | 110° | 55 | |
| | 19 | 01:01:30 | 182° | 65° | 65° | 170° | 110° | 60 | 56° |
| | 20 | 01:06:30 | 181° | 65° | 65° | 170° | 110° | 5 | |
| | 21 | 01:11:30 | 181° | 65° | 65° | 170° | 110° | 10 | |
| | 22 | 01:16:30 | 180° | 60° | 60° | 170° | 108° | 15 | |
| | 23 | 01:21:30 | 180° | 60° | 60° | 170° | 107° | 20 | |
| | 24 | 01:26:30 | 179° | 60° | 60° | 170° | 106° | 25 | |
| | 25 | 02:31:30 | 170° | 60° | 60° | 170° | 105° | 30 | |
| | 26 | 01:36:30 | 178° | 60° | 60° | 170° | 105° | 35 | 56° |
| | 27 | 02:01:30 | 173° | 60° | 60° | 170° | 105° | 60 | 56° |
| | | | | | | | | OUTSIDE TEMPERATURE 27° | |

All Temperatures in Degrees of Fahrenheit

TABLE II

| READING | | TIME | BOILER TEMP. | OUTSIDE FLUE STACK TEMPERATURE LOWER | OUTSIDE FLUE STACK TEMPERATURE UPPER | INSIDE FLUE STACK TEMPERATURE LOWER | INSIDE FLUE STACK TEMPERATURE UPPER | TIME FROM FURNACE SHUTDOWN | BASEMENT TEMPERATURE |
|---|---|---|---|---|---|---|---|---|---|
| | | | | | | | | OUTSIDE TEMPERATURE 30° | |
| START | 1 | 5:42:30 | 150° | | | | | | |
| | 2 | 5:44:30 | 155° | 115° | 125° | 560° | 495° | | 57° |
| | 3 | 5:46:30 | 160° | 150° | 160° | 585° | 530° | | |
| | 4 | 5:48:30 | 165° | 190° | 190° | 590° | 540° | | |
| | 5 | 5:50:30 | 170° | 215° | 210° | 600° | 550° | | |
| OFF | 6 | 5:52:30 | 180° | 230° | 220° | 610° | 560° | | |
| | 7 | 5:57:30 | 188° | 200° | 150° | 300° | 180° | 5 | 58° |
| | 8 | 6:02:30 | 190° | 130° | 90° | 200° | 95° | 10 | |
| | 9 | 6:07:30 | 190° | 95° | 60° | 170° | 60° | 15 | |
| | 10 | 6:13:30 | 190° | 80° | 50° | 170° | 50° | 20 | 58° |
| | 11 | 6:18:30 | 190° | 75° | 50° | 170° | 49° | 25 | |
| | 12 | 6:23:30 | 190° | 70° | 50° | 165° | 47° | 30 | |
| | 13 | 6:28:30 | 189° | 65° | 50° | 160° | 45° | 35 | |
| | 14 | 6:33:30 | 189° | 65° | 50° | 160° | 45° | 40 | |
| | 15 | 6:38:30 | 189° | 65° | 50° | 160° | 45° | 45 | |
| | 16 | 6:43:30 | 189° | 65° | 50° | 160° | 45° | 50 | |
| | 17 | 6:48:30 | 188° | 63° | 48° | 160° | 45° | 55 | 58° |
| | 18 | 6:52:30 | 188° | 63° | 48° | 160° | 45° | 60 | |
| | 19 | 6:57:30 | 188° | 55° | 48° | 160° | 45° | 5 | |
| | 20 | 7:02:30 | 187° | 55° | 48° | 160° | 45° | 10 | |
| | 21 | 7:07:30 | 187° | 55° | 48° | 160° | 43° | 15 | |
| | 22 | 7:12:30 | 186° | 55° | 48° | 160° | 43° | 20 | 58° |
| | 23 | 7:17:30 | 186° | 55° | 48° | 160° | 43° | 25 | |
| | 24 | 7:22:30 | 185° | 55° | 48° | 160° | 43° | 30 | |
| | 25 | 7:27:30 | 185° | 55° | 48° | 160° | 43° | 35 | |
| | 26 | 7:52:30 | 181° | 55° | 45° | 150° | 40° | 60 | 58° |
| | | | | | | | | OUTSIDE TEMPERATURE 27° | |

All Temperatures in Degrees of Fahrenheit

As indicated above in the following Tables, Table I records the temperature at each sensor when the furnace is off, when the furnace is running and after shut down for approximately a two-hour period without the damper of the present invention being employed in Table I and in Table II, when the damper of the present invention is employed.

The temperatures recorded demonstrate clearly the extreme loss of heat up the chimney after furnace shut down when the damper of the present invention is not employed and the saving of heat loss utilizing the damper of the present invention. Not shown in FIG. 8 is the usual stabilized draft damper employed on an exhaust stack, but it should be understood that it is employed in the usual manner according to the particular installation.

The effect of the damper of the present invention is graphically illustrated by reference to Table I and which show temperatures at indicated times after the furnace is turned off. A temperature of over 100° F. in the upper stack without the damper of this invention for two hours after the furnace is turned off shows that an extreme amount of heat is "going up the chimney." In contrast, within 15–20 minutes after the furnace is turned off with the damper of the present invention being utilized, the upper stack temperature drops below 50° F. when there is an outside temperature of 27°. Also it should be noted that the basement temperature remains constant when the damper of the present invention is utilized.

The foregoing is illustrative of the effectiveness of the damper of the present invention which is very economical to manufacture, being very simple in structure.

While the invention has been explained by a detailed description of certain specific embodiments, it is understood that various modifications and substitutions can be made in any of them within the scope of the appended claims which are intended also to include equivalents of such embodiments.

What is claimed is:

1. A damper for sealing and unsealing a vertical furnace exhaust flue pipe to minimize the escape of heat when the furnace is not operating, said damper comprising a cylindrical body adapted to form a section of vertical flue pipe having inner and outer walls, said cylindrical body having a top opening and a bottom opening, at least one transverse hinge rod horizontally transversing said body carried by opposed apertures in opposing wall portions of the body, an annular rim mounted on the inner wall of the body, a pair of oppositely extending gull-wing shaped damper shutters pivotably mounted on said hinge rod, each of said pair of gull-wing shaped damper shutters having upper and lower surfaces, each of said gull-wing shaped shutters having a lower section and an outer upper section, and in the closed condition the lower sections of the shutters extending upwardly and outwardly at approximately a 45° angle and the outer upper sections of the shutters extending horizontally and slightly spaced from the inner walls of the damper section, the upper surface of said annular rim being contoured to match the lower surface of said shutters along their edges in the closed condition so that the edges of the lower surface of said shutters rest on said rim to close said damper, and the lower edges of said shutters engaging said annular rim so as to prevent the lower edges from becoming wedged against the inner wall of the damper section, said gull-wing shaped damper shutters opening to a vertical position when said furnace is operating and closing when said furnace is not operating.

2. A damper as claimed in claim 1 wherein a second transverse rod is provided above said hinge rod to prevent said wings from swinging past the vertical when fully open.

3. A damper as claimed in claim 1 wherein at least one end of at least one of said hinge rods is provided with thermostatically operated spring means to open and close at least one gull shutter, and apertures located above and below said hinge rods in said walls, an enclosure mounted externally on said walls and enclosing said apertures in spaced relationship therefrom, whereby when said furnace is operating, warm air is directed through said apertures and over said thermostatically operated spring means to cause said damper to open, and wherein when said furnace is inoperative, ambient air is directed over said thermostatically operating spring means to cause said damper to close.

* * * * *